US007636039B2

(12) United States Patent
Babich

(10) Patent No.: US 7,636,039 B2
(45) Date of Patent: Dec. 22, 2009

(54) MOTION DETECTOR WIRELESS REMOTE SELF-TEST

(75) Inventor: Thomas S. Babich, Glen Cove, NY (US)

(73) Assignee: Honeywell International Inc., Morristown, NJ (US)

( * ) Notice: Subject to any disclaimer, the term of this patent is extended or adjusted under 35 U.S.C. 154(b) by 250 days.

(21) Appl. No.: 10/999,033

(22) Filed: Nov. 29, 2004

(65) Prior Publication Data

US 2006/0125621 A1 Jun. 15, 2006

(51) Int. Cl.
*G08B 29/00* (2006.01)

(52) U.S. Cl. ..... 340/514; 340/539.1; 340/539.11; 340/539.24; 340/539.25; 340/541; 340/507; 340/515

(58) Field of Classification Search ..... 340/514, 340/506, 507, 515, 516, 539.1, 539.11, 539.24, 340/539.25, 539.26, 541, 545.2, 545.3, 545.4, 340/565
See application file for complete search history.

(56) References Cited

U.S. PATENT DOCUMENTS

| | | | | |
|---|---|---|---|---|
| 5,867,099 | A * | 2/1999 | Keeter | 340/567 |
| 6,593,850 | B1 * | 7/2003 | Addy | 340/501 |
| 6,737,967 | B2 * | 5/2004 | Farley | 340/514 |
| 6,762,688 | B2 * | 7/2004 | Johnston et al. | 340/628 |
| 6,768,868 | B1 * | 7/2004 | Schnell | 396/263 |
| 7,034,703 | B2 * | 4/2006 | Morris | 340/628 |
| 7,356,429 | B2 * | 4/2008 | Eskildsen | 702/104 |
| 2005/0128067 | A1 * | 6/2005 | Zakrewski | 340/511 |

* cited by examiner

*Primary Examiner*—Daryl Pope
(74) *Attorney, Agent, or Firm*—Husch Blackwell Sanders Welsh & Katz

(57) ABSTRACT

An apparatus and method are provided for a security device for residential and/or commercial buildings. A motion detector is installed on a fixture such as a wall or ceiling. A wireless remote is used after installation of the motion detector to set the motion detector to a walk test mode, eliminating the need for the installer to open up the motion detector to switch it to a walk test mode. After walk testing the motion detector, the wireless remote is used to set the motion detector back to a normal mode, eliminating the need for the installer to open up the motion detector and avoiding the problem of the installer forgetting to switch it back to a normal mode. The motion detector can also switch back to a normal mode after a predetermined amount of time by use of a timer.

24 Claims, 1 Drawing Sheet

MOTION DETECTOR WIRELESS REMOTE SELF-TEST

BACKGROUND OF THE INVENTION

1. Field of the Invention

The present invention relates to motion detectors for residential and commercial buildings, and more specifically, to motion detectors that allow for a remote wireless self-test of the motion detector.

2. Prior Art

A motion detector generates an alarm signal when the detector detects unauthorized activity in or around a protected volume of space.

After an installer installs the detector, the installer tests the detector to ensure that it is functioning properly. To test a motion detector, the installer walks throughout the motion sensor's field of view to cause the generation of a sensing signal. In response to the sensing signal, a detected-event indicator such as an LED may be illuminated.

To perform the test, the installer may be required to switch the detector into a test mode. This is conventionally done by opening the housing of the detector and installing a jumper or actuating a switch. However, many detectors are mounted in hard- to-reach locations, such as on ceilings. Switching such a hard-to-reach detector into a test mode is inconvenient, or even dangerous, for the installer.

Further, after installing the jumper or actuating a switch, the operator has to then close the housing of the detector, wait and allow the motion detector to settle, and then walk test the unit. At the completion of walk testing the unit, either the unit times out or the cover of the housing has to once again be re-opened and the settings have to be returned to their normal position.

A second problem exists if the installer, after walk testing the unit, forgets to reset the motion detector to its original settings. In this case, the motion detector remains in the walk test mode, and a site visit will then be required for the installer to correct the problem. This can increase the expenses associated with the unit. Also, battery operated units would discharge the batteries much faster in this mode.

Therefore, it is desirable to be able to switch the motion detector into a walk test mode remotely, obviating the need to open, or even physically contact, the motion detector. Further, it is desirable to be able to switch the motion detector back to its original settings without the need to go back and open the motion detector, and make the adjustments to switch it back to its normal mode again.

Thus, there remains a distinct need for a simplified and inexpensive installation and testing of motion detectors in home and commercial buildings.

SUMMARY OF THE INVENTION

Therefore, it is an object of the present invention to provide a motion detection device for home and commercial buildings that allows for remote wireless walk testing and restoring the motion detector back to its original settings.

To achieve the foregoing and other objects and in accordance with the purpose of the present invention, as embodied and broadly described herein, a security device for residential and/or commercial use is provided that comprises a motion detector, wireless remote means for setting the motion detector to a walk-test mode from a normal mode, and wireless remote means for setting the motion detector back to a normal mode from the walk-test mode.

The wireless remote means can be a remote control, and the remote control comprises keys for setting the motion detector to the walk-test mode and the normal mode. The keys are used for adjusting parameters of the motion detector. The wireless remote means sets the motion detector to a walk-test mode and normal mode by sending a preset series of signals to the motion detector, which can be one of microwave signals, light signals, infrared signals, or radio frequency signals. The motion detector is installed on a wall or ceiling, and a camera can be used with the motion detector.

Further, a security device for residential and/or commercial use is provided that comprises a motion detector, a wireless remote means for setting the motion detector to a walk-test mode from a normal mode, and a timer set to a predetermined amount of time so that the motion detector automatically switches back to the normal mode from the walk-test mode after expiration of the predetermined amount of time.

Also provided is a method of installing a residential and/or commercial security device, comprising the steps of installing a motion detector on a fixture, remotely wirelessly controlling the motion detector to set the motion detector to a walk test mode, and walk testing the motion detector.

The method further comprises remotely wirelessly controlling the motion detector to set the motion detector to a normal mode from the walk test mode, or automatically switching the motion detector back to the normal mode from the walk test mode after a predetermined amount of time. The method further comprises remotely wirelessly adjusting parameters of the motion detector. The step of remotely wirelessly controlling the motion detector is achieved by sending a preset series of signals to the motion detector from a wireless remote control.

The above and other features of the invention, including various novel details of construction and combinations of parts, will now be more particularly described with reference to the accompanying drawing and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWING

These and other features, aspects, and advantages of the apparatus and methods of the present invention will become better understood with regard to the following description, appended claims, and accompanying drawing where:

The FIGURE shows a motion detector and a wireless remote used to control walk testing of the motion detector.

DETAILED DESCRIPTION OF THE INVENTION

Figure 1:
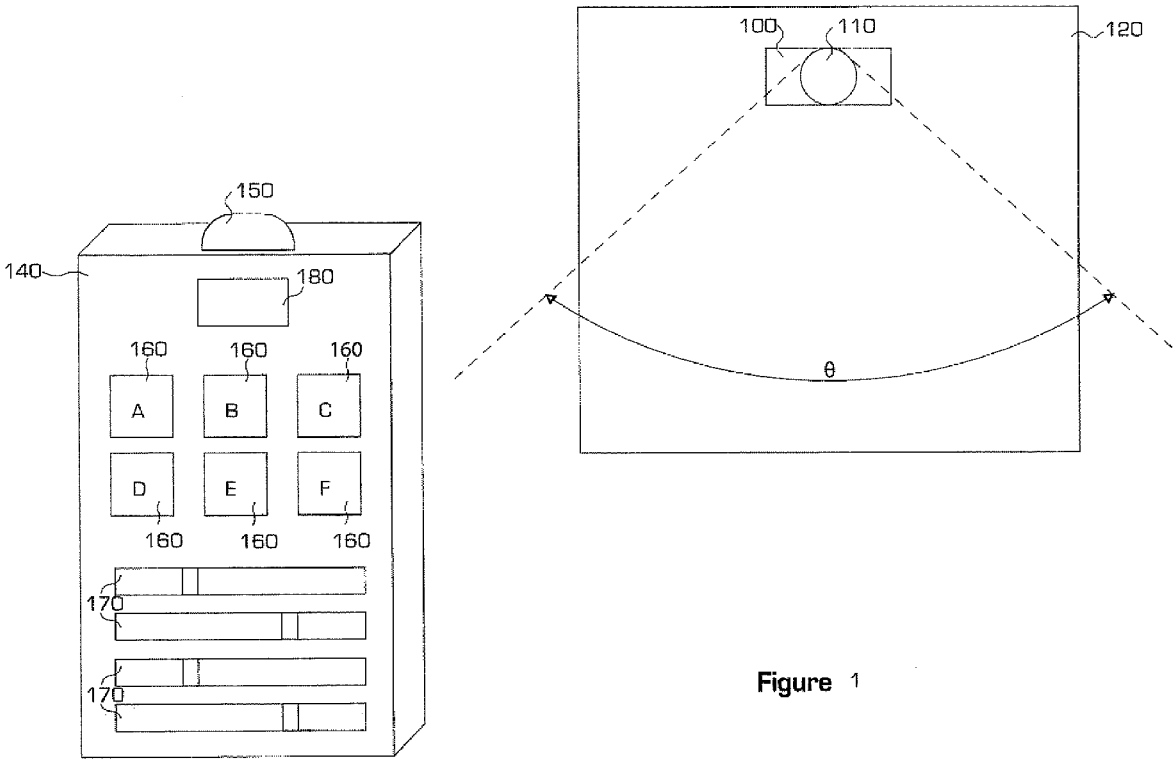

Although this invention may be applicable to various intrusion detection devices, it has been found particularly useful in the environment of motion detectors for commercial and residential structures. Therefore, without limiting the applicability of the invention to the above, the invention will be described in such environment.

With reference now to the drawing, the components of the present invention will be described. In the FIGURE, a motion detector 100 is shown mounted or installed on a wall 120. The motion detector 100 could also be mounted on a ceiling or any other fixture that would support the motion detector 100. The motion detector 100 can include a camera 110 or be any other type of motion detector known in the art.

A motion detector camera includes a camera mechanism 110 mounted inside a housing, a motion detector 100 exposed on a surface of the housing, and a controller (not shown) for controlling the camera mechanism in response to signals received from the motion detector 100. The camera 110 can include a shutter button located external to the housing to manually activate the camera mechanism. A camera support can be used to removably mount the camera to an object, such as a wall 120 or ceiling.

The motion detector 100 covers an area θ so that if any person or object moved within the area θ the motion detector 100 would trigger an alarm (not shown), such as an LED or sound known in the art. The motion detector 100 can be in a stand-by mode, where it will not sound an alarm, or in an active mode, where the alarm will be triggered, both of which are hereby referred to as a "normal mode".

A wireless remote 140, such as a remote control, is used by the installer of the motion detector 100 to test the motion detector 100 after installation of the motion detector 100 on a wall 120 or ceiling. Keys 160 (labeled A-F) on the wireless remote 140 can be used to set the motion detector 100 to a walk test mode or a normal mode.

In an illustrative embodiment, pressing key A will send a preset series of signals to the motion detector 100 through sending means 150 and cause the motion detector 100 to go into walk test mode. This would eliminate the need for the installer of the motion detector 100 to go back to the unit, which could be located high on a wall or ceiling, and open the unit and switch the unit to walk test mode. The sending means 150 can be any type of means that is used in remote controls, such as but not limited to infrared signals, microwave signals, light signals, radio frequency or any other type of wireless means. The sending means 150 may also be a sound, such as a glass break simulator sending out a sequence of sounds. The motion detector 100 would respond to the sound. Keys B and C can be used to make any adjustments to certain parameters of the walk test mode of the motion detector 100, such as the range or angle of θ, sensitivity, pulse count, pet immunity, and any other type of settings that can be adjusted on the motion detector 100.

Further, keys B and C can be used to set a timer (not shown) on the motion detector 100, thus setting the motion detector 100 into walk test mode for a predetermined amount of time. Thus, after a predetermined amount of time, as set by the wireless remote 140, the motion detector 100 will automatically switch back to normal mode. The installer can set this time by using the wireless remote 140, and by estimating how much time it will take to walk test the motion detector 100. This way, the installer does not have to worry about setting the motion detector 100 back to normal mode. If the installer needs more time to walk test the motion detector 100 and the time expires, the installer can again press key A to set the unit back to walk test mode, or again set the timer for a specified amount of time. A warning signal, such as a light, beep, or flashing LED, can be set off on the wireless remote 140 when the predetermined time is about to expire.

Alternatively, a timer 180 is provided in the wireless remote 140. The timer 180 in the wireless remote 140 is set as described previously using keys B and C to set the motion detector 100 into walk test mode for a predetermined amount of time. When the predetermined amount of time set in the timer 180 expires, a signal corresponding to a return to normal mode is sent by the wireless remote 140 to the motion detector 100 via the sending means 150.

Alternatively, instead of using a timer, pressing key D will send a preset series of signals to the motion detector 100 through sending means 150 and cause the motion detector 100 to go back into normal mode from walk test mode. Again, this would eliminate the need for the installer to go back to the unit and switch it back to its original normal settings. If the installer finishes before time when using the timer, the installer can simply press key D early and the motion detector will switch back to normal mode immediately and eliminate the remaining time left on the timer. Keys E and F can be used to make adjustments to the normal mode of the motion detector 100.

Settings 170 can be used to make any other adjustments required or needed, such as zooming or focusing of the camera 110, intensity of the LED alarm, volume of the alarm signal, range and distance of θ, etc.

Further, the wireless remote 140 does not need to be a separate unit. Any electronic device capable of wireless control can be used, such as a TV remote or any other electronic device wireless remote (VCR, CD, DVD, etc.), a cellular phone, a pager, etc.

Now, operation of the present invention in the illustrative embodiment will be described with references to the FIGURES and components described above.

After installation of the motion detector on a wall 120 or a ceiling, an installer can use the wireless remote 140 when the installer is ready to test the motion detector. First, the installer can use keys B and C to make adjustments to the motion detector 100, such as the range or angle of θ. Then, once θ has been set, preferably to an angle between 1 and 180 degrees, the installer presses key A that sends a preset series of signals to the motion detector 100 through sending means 150 and causes the motion detector 100 to go into walk test mode. As mentioned above, these signals can be infrared signals, light signals, microwave signals, radio frequency signals, or even sound.

Now the installer can walk through the area covered by θ to test the motion detector 100 to see if the alarm would trigger when the installer walks in the area occupied by θ. The installer can further set a time on a timer so that the motion detector 100 automatically switches back to normal mode after the time that is set expires.

Alternatively, after determining if the alarm is working or not, the installer can now set the motion detector 100 into a normal mode from walk test mode by pressing key D, which sends a preset series of signals to the motion detector 100 to revert to normal mode. Again, this would eliminate the need for the installer to go back to the unit and switch it back to its original normal settings.

The present invention provides several advantages that solves the problems with prior art methods. In the prior art, the installer would have to keep going back to the motion detector and adjust the settings and to set it to walk test mode, and then go back to revert it to a normal mode. In the present invention, the installer is able to adjust the settings of the motion detector, and go from normal mode to walk test mode, and back to normal mode, by using a wireless remote 140. This eliminates significant time needed to set the motion detector by the installer, who has to usually climb a ladder to reach the motion detector. It is also less dangerous for the installer, who can test the motion detector without having to climb or reach the motion detector itself. This can also significantly reduce the rate of installing a motion detector for the consumer. Further, by setting a timer on the motion detector, the problem of forgetting to switch the unit back to normal mode is eliminated.

There are several other uses of the invention not limited by the description and embodiment as described above. The invention may also be applicable to other electronic surveillance and alarm security systems for commercial and residential buildings. Any type of motion detector known in the art may be used, regardless of the type of motion detection technique used. Other wireless remote means known in the art may be used instead of a remote control. Any type of wireless signals can be transmitted from the wireless remote to the motion detector.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A security device for residential and/or commercial use, said security device comprising:

a motion detector having an audible alarm;

wireless remote means for setting said motion detector to a walk-test mode from a normal mode;

wireless remote means for setting said motion detector back to a normal mode from said walk-test mode;

a timer activated by setting the motion detector to the walk-test mode that automatically switches the motion detector from the walk-test mode to a normal mode after a predetermined time period; and a warning signal that the predetermined time period is about to expire.

2. The security device for residential and/or commercial use of claim 1, wherein said wireless remote means comprises a remote control.

3. The security device for residential and/or commercial use of claim 2, wherein said remote control comprises keys for setting said motion detector to said walk-test mode and said normal mode.

4. The security device for residential and/or commercial use of claim 3, wherein said keys are used for adjusting parameters of said motion detector.

5. The security device for residential and/or commercial use of claim 1, wherein said wireless remote means sets said motion detector to a walk-test mode and normal mode by sending a preset series of signals to said motion detector.

6. The security device for residential and/or commercial use of claim 5, wherein said signals are one of microwave signals, light signals, infrared signals or radio frequency signals.

7. The security device for residential and/or commercial use of claim 5, wherein said signals are sound signals.

8. The security device for residential and/or commercial use of claim 1, wherein said motion detector is installed on a wall or ceiling.

9. The security device for residential and/or commercial use of claim 1, further comprising a camera.

10. The security device for residential and/or commercial use of claim 1, further comprising wireless means for switching said motion detector back to a normal mode from said walk-test mode after a predetermined amount of time.

11. The security device for residential and/or commercial use of claim 10, wherein said wireless switching means comprises a timer.

12. A method of installing a residential and/or commercial security device, said method comprising the steps of:

installing a motion detector having an audible alarm on a fixture;

remotely wirelessly controlling said motion detector to set said motion detector to a walk test mode;

setting a timer that automatically switches said motion detector from the walk test mode to a normal mode after a predetermined time period;

walk testing said motion detector; and setting off a warning signal that the predetermined time period is about to expire.

13. The method of installing a residential and/or commercial security device of claim 12, further comprising: remotely wirelessly controlling said motion detector to set said motion detector to a normal mode from said walk test mode.

14. The method of installing a residential and/or commercial security device of claim 12, further comprising: automatically switching said motion detector back to said normal mode from said walk test mode after a predetermined amount of time.

15. The method of installing a residential and/or commercial security device of claim 12, further comprising: remotely wirelessly adjusting parameters of said motion detector.

16. The method of installing a residential and/or commercial security device of claim 12, wherein said step of remotely wirelessly controlling said motion detector is achieved by sending a preset series of signals to said motion detector from a wireless remote control.

17. A security device for residential and/or commercial use, said security device comprising:

a motion detector having an audible alarm;

wireless remote means for setting said motion detector to a walk-test mode from a normal mode;

a timer set to a predetermined amount of time so that the motion detector automatically switches back to said normal mode from said walk-test mode after expiration of said predetermined amount of time; and a warning signal that the predetermined time is about to expire.

18. The security device for residential and/or commercial use of claim 17, wherein said wireless remote means comprises a remote control.

19. The security device for residential and/or commercial use of claim 18, wherein said remote control comprises keys for setting said motion detector to said walk-test mode and said normal mode.

20. The security device for residential and/or commercial use of claim 19, wherein said keys are used for adjusting parameters of said motion detector.

21. The security device for residential and/or commercial use of claim 17, wherein said wireless remote means sets said motion detector to a walk-test mode and normal mode by sending a preset series of signals to said motion detector.

22. The security device for residential and/or commercial use of claim 21, wherein said signals are one of microwave signals, light signals, infrared signals, or radio frequency signals.

23. The security device for residential and/or commercial use of claim 21, wherein said signals are sound signals.

24. The security device for residential and/or commercial use of claim 17, wherein said motion detector is installed on a wall or ceiling.

* * * * *

UNITED STATES PATENT AND TRADEMARK OFFICE

CERTIFICATE OF CORRECTION

PATENT NO. : 7,636,039 B2
APPLICATION NO. : 10/999033
DATED : December 22, 2009
INVENTOR(S) : Thomas S. Babich It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 454 days.

Signed and Sealed this

Ninth Day of November, 2010

David J. Kappos

David J. Kappos
*Director of the United States Patent and Trademark Office*